US005640909A

United States Patent [19]

Theurer

[11] Patent Number: 5,640,909

[45] Date of Patent: Jun. 24, 1997

[54] METHOD AND MACHINE FOR TAMPING AND STABILIZING A TRACK

[75] Inventor: Josef Theurer, Vienna, Austria

[73] Assignee: Franz Plasser Bahnbaumaschinen-Industriegesellschaft M.B.H., Vienna, Austria

[21] Appl. No.: 599,327

[22] Filed: Feb. 9, 1996

[30] Foreign Application Priority Data

Feb. 9, 1995 [AT] Austria ..... 244/95

[51] Int. Cl.[6] ..... B61F 5/00

[52] U.S. Cl. ..... 104/7.2; 104/2; 104/12

[58] Field of Search ..... 104/2, 7.1, 7.2, 104/12, 8

[56] References Cited

U.S. PATENT DOCUMENTS

| | | | |
|---|---|---|---|
| 4,046,078 | 9/1977 | Theurer . | |
| 4,046,079 | 9/1977 | Theurer . | |
| 4,430,946 | 2/1984 | Theurer et al. . | |
| 4,643,101 | 2/1987 | Theurer | 104/7.2 |
| 4,881,467 | 11/1989 | Theurer | 104/12 |
| 5,127,333 | 7/1992 | Theurer | 104/2 |
| 5,172,635 | 12/1992 | Theurer . | |

FOREIGN PATENT DOCUMENTS 2094379 9/1982 United Kingdom .

OTHER PUBLICATIONS

*Railway Track and Structures,* Mar. 1984, pp. 48, 49, 51, 52 "High–speed DTS 'train tamps' track".

*Primary Examiner*—Mark T. Le
*Attorney, Agent, or Firm*—Collard & Roe P.C.

[57] ABSTRACT

A track is tamped and stabilized at a desired level by lifting the track to a temporary level, intermittently tamping the track and then advancing along the track in an operating direction in continuously repeated tamping cycles, and in continuously repeated stabilizing cycles parallel to and following the tamping cycles in the operating direction, intermittently stabilizing the tamped track at the desired level by imparting to the track horizontal vibrations extending in a direction perpendicular to the track, and applying to the vibrating track a vertical load at a value automatically controlled to rise to a maximum value required to lower the track to the desired level and then reduced to a value to relieve the load.

17 Claims, 2 Drawing Sheets

METHOD AND MACHINE FOR TAMPING AND STABILIZING A TRACK

BACKGROUND OF THE INVENTION

1. Field of the Invention

The present invention relates to a method of tamping and stabilizing a track at a desired level, which comprises the steps of lifting the track to a temporary level, intermittently tamping the track and then advancing along the track in an operating direction, and stabilizing the tamped track at the desired level by imparting to the track horizontal vibrations extending in a direction perpendicular to the track, and applying to the vibrating track a vertical load to obtain the desired track level, as well as to a machine for carrying out this method.

2. Description of the Prior Art

A track tamping and stabilizing method and machine of this general type has been disclosed in U.S. Pat. No. 5,172,635. According to this patent, a track position correction obtained by tamping is combined with the subsequent compaction of the tamped track by imparting to the track horizontal vibrations extending in a direction perpendicular to the track and applying to the vibrating track a vertical load. The ballast supports for the track ties are obtained by immersing reciprocating tamping tools in the cribs between the ties and tamping the ballast under the ties whereby the homogeneity of the ballast bed is disturbed, and the tamped track is then lowered to the desired level. This dynamic stabilization of the tamped track avoids the initial settling of the track which is an unavoidable result of the tamping.

The dynamic track stabilization produces a controlled lowering of the track while a track stabilization car continuously advances along the track in an operating direction and the vertical load remains constant at a constant value. Immediately preceding the track stabilization in the operating direction and parallel thereto, a tamping machine advances continuously while a tamping assembly on the machine is displaced relative thereto to enable the ties to be intermittently tamped.

As has been known for some time and has been described, for example, in an article entitled "High-speed DTS 'train tamps' track" in Railway Track & Structures, March 1984, pp. 48–52 (see particularly p. 48, col. 1, lines 39, 40, and col. 3, lines 7–9), in commercial practice the dynamic track stabilizers have worked continuously during the track surfacing operation while the machine advances continuously along the track. Such track surfacing has achieved worldwide success for more than a decade and, as mentioned on page 52, col. 2, of this article, particularly high production is obtained by combining the continuously advancing track high-speed stabilization machine with an equally continuous motion tamper.

U.S. Pat. Nos. 4,046,078, 4,046,079 and 4,430,946, and British patent No. 2,094,379 disclose intermittently advancing machine units combining track tamping with the dynamic stabilization of the tamped track. However, none of these machines combining track tamping with track stabilization in one operation have gained practical acceptance.

SUMMARY OF THE INVENTION

It is the primary object of this invention to provide an efficient method and machine for tamping and stabilizing a track at a desired level, with a minimum of operating personnel and machinery, by combining an intermittently advancing tamper with a dynamic track stabilizer which avoids the otherwise unavoidable initial settling of a tamped track.

The above and other objects are accomplished according to one aspect of the invention with a method of tamping and stabilizing a track at a desired level, which comprises the steps of lifting the track to a temporary level, intermittently tamping the track and then advancing along the track in an operating direction in continuously repeated tamping cycles, and in continuously repeated stabilizing cycles parallel to, and following the tamping cycles in the operating direction, intermittently stabilizing the tamped track at the desired level by imparting to the track horizontal vibrations extending in a direction perpendicular to the track, and applying to the vibrating track a vertical load at a value automatically controlled to rise to a maximum value required to lower the track to the desired level and then reduced to a value to relieve the load.

According to another aspect, the invention provides a machine for tamping and stabilizing a track consisting of rails fastened to ties, which comprises a machine frame supported on the track by undercarriages and adapted to be advanced intermittently from tie to tie in an operating direction, a vertically adjustable tamping assembly mounted on the machine frame, a vertically adjustable track lifting and lining unit mounted on the machine frame, and a reference system mounted on the machine frame and including a measuring carriage running on the track for controlling lifting of the track by the lifting and lining unit to a temporary level. Furthermore, a track stabilization car is arranged rearwardly of the machine frame in the operating direction and supported on the track by an undercarriage, the track stabilization car having a forward end in the operating direction, a track stabilization assembly is mounted on the track stabilization car, the track stabilization assembly comprising means for imparting to the track horizontal vibrations extending in a direction perpendicular to the track, and means for applying to the vibrating track a vertical load at a value automatically controlled to rise to a maximum value required to lower the track to the desired level and then reduced to a value to relieve the load. A universal coupling connects a forward end of the track stabilization car to the machine frame, and a further reference system on the track stabilization oar determines the desired track level.

With this method and machine, intermittent track tamping is combined with intermittent track stabilization proceeding parallel thereto. The alternating application of two different vertical load values during the track stabilization cycles, i.e. a maximum value to obtain the desired track level and a reduced value to relieve the load, for the first time makes it possible to harmonize the track stabilization optimally with the preceding intermittent track tamping. In particular, different stabilization effects and resultant differences in the lowering of the track are thus avoided. Although the speed of the operation is somewhat reduced in comparison with the work of the continuous-motion machines, the method and machine of the present invention will produce a simplified track position correction with a saving in operating personnel and machinery, which is particularly useful for shorter track sections.

BRIEF DESCRIPTION OF THE DRAWING

The above and other objects, advantages and features of this invention will become more apparent from the following detailed description of certain now preferred embodiments thereof, taken in conjunction with the accompanying, partly diagrammatic drawing wherein.

DETAILED DESCRIPTION OF THE PREFERRED EMBODIMENTS

Figure 1:
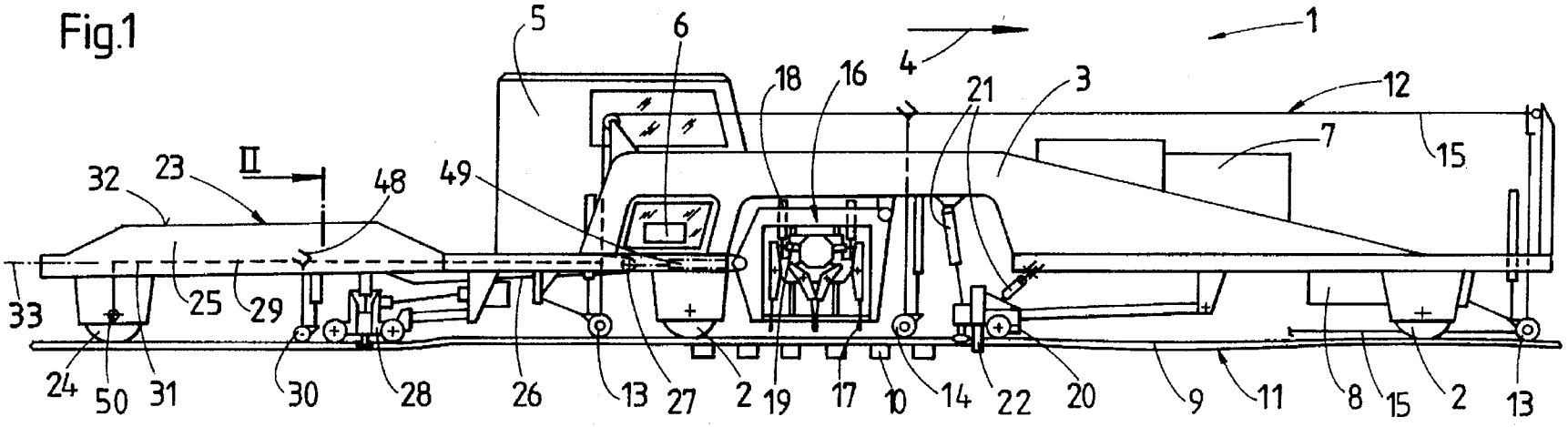
FIG. 1 is a side elevational view of a track tamping and stabilization machine according to the invention.

Referring now to the drawing and first to FIG. 1, there is shown machine 1 for tamping and stabilizing track 11 consisting of rails 9 fastened to ties 10. The machine comprises machine frame 3 supported on the track by undercarriages 2 and adapted to be advanced intermittently by drive 8 from tie to tie in an operating direction indicated by arrow 4. A power plant 7 is mounted on machine frame 3 to provide energy to the drives of the machine.

Mounted on machine frame 3 are a vertically adjustable tamping assembly 16, a vertically adjustable track lifting and lining unit 20, and a reference system 12. The tamping assembly is arranged immediately ahead of rear undercarriage 2, in the operating direction, and is adapted to tamp two adjacent ties 10 in each tamping cycle. It comprises two pairs of vibratory tamping tools 17 immersible in the cribs adjacent the two ties and reciprocable in the direction of the longitudinal extension of machine frame 3 by drives 19 to tamp ballast under the two ties. Drives 18 are connected to tamping assembly 16 for vertical adjustment thereof. Such tamping assemblies are conventional. The track lifting and lining unit comprises vertically and laterally adjustable lifting tools 22 for gripping track 11, and it is vertically and laterally adjustable by drives 21 for lifting and lining the track. Track lifting and lining unit 20 runs on track rails 9 on flanged rollers. Such units are also conventional. Reference system 12 includes two end measuring carriages 13, 13 and a center measuring carriage 14 running on track 11. Tensioned reference wire 15 extends between the end measuring carriages, and the track lifting and lining unit is arranged immediately ahead of center measuring carriage 14, in the operating direction, for controlling lifting of the track to a temporary level. Such reference systems, too, are conventional.

Track stabilization car 23 is arranged rearwardly of machine frame 3, in the operating direction, and chassis 25 thereof is supported on track 11 by undercarriage 24. Forward end 26 of track stabilization car chassis 25 is connected by universal coupling 27 to machine frame 3 of tamping machine 1. A track stabilization assembly 28 is mounted on the track stabilization car about centrally between universal coupling 27 and undercarriage 24. A further reference system 29 on track stabilization car 23 detects any level error of the tamped track and determines the desired track level. Reference system 29 comprises a tensioned wire 31 whose forward end, in the operating direction, is carried by rear measuring car 13 of reference system 12 and whose rear end is carried by journal box 50 of undercarriage 24. It further comprises vertically adjustable measuring carriage 30 running on track 11 immediately behind track stabilization assembly 28, in the operating direction. Such a dynamic track stabilization arrangement is known.

The track stabilization car chassis 25 extends in horizontal plane 33 (indicated in phantom lines) passing through universal coupling 27, and the chassis defines upper boundary 32 of the car 23. Operator's cab 5 is mounted at an end of machine frame 3 in the region of the universal coupling 27 and overlooks the upper boundary of the car. In this way, an operator in cab 5, who handles the tamping and stabilizing operations, can also drive machine 1 in a direction opposite to the operating direction, for example when the machine is driven to another operating site. Central control panel 6 is arranged in the operator's cab.

Figure 2:
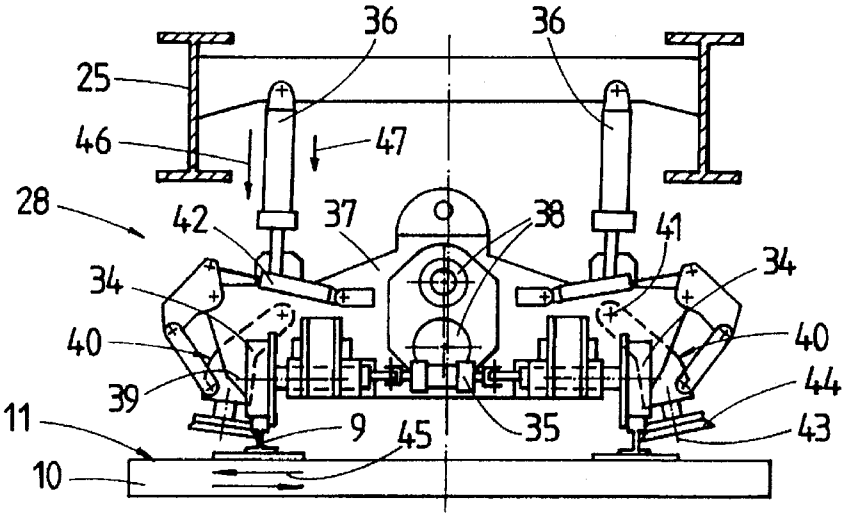
FIG. 2 is an enlarged end view, partly in section, of the track stabilization assembly, taken along line II of FIG. 1.

Track stabilization assembly 28 shown in FIG. 2 is of a type fully described and illustrated, for example, in U.S. Pat. Nos. 4,046,078 and 4,046,079. It runs on two pairs of flanged rollers 34 on rails 9 of track 11. To engage the flanges of the rollers without play with the track rails, hydraulically operated spreading drives 35 extend between the opposite rollers of each pair and press the flanges of these rollers against the gage sides of the rails. The track stabilization assembly further comprises means for imparting to track 11 horizontal vibrations extending in a direction perpendicular to the track and parallel to axes of rotation 39 of rollers 34, as indicated by arrows 45. This means is illustrated as vibrators 38 mounted on housing 37 linked to chassis 25 by drives 36. The vibrators are eccentric drives. A roller clamp 40 is mounted on housing 37 between the two rollers engaging each rail 9 and is pivotal by hydraulic drive 42 about axis 41 into engagement with the field sides of rails 9. The lower end of each roller clamp 40 carries a horizontally extending roller disk 44 freely rotatable about vertical axis 44. In this way, track 11 is tightly held during the stabilization operation. Vertically extending hydraulic drives 36 are means for applying to the vibrating track a maximum vertical load, as indicated by arrow 46, and the pressure applied to drives 36 can be automatically controlled from central control 6 at a maximum value to obtain the desired track level and for reducing the maximum value of the vertical load to relieve the load, as indicated by shorter arrow 47. The value of the vertical load is preferably reduced by 20 to 100 percent to a minimal load required to keep track stabilization assembly 28 running on the track. The vertical load imparted to track 11 may be steplessly adjusted up to about 300 kilonewton by feeding hydraulic pressure to drives 36 through a proportional pressure valve.

As used throughout the specification and claims, the term "maximum load" is understood to designate the load required to compact the ballast to the extent required to settle the vibrating track at the desired level as it is pressed into the ballast. The value of this maximum load depends on many parameters, such as the vertical distance between the temporary level of the tamped track and the desired level, the duration of the stabilizing cycle, the types of tampers and stabilizers used, etc.

As indicated in phantom lines in FIG. 1, universal coupling 27 may be mounted on machine frame 3 for displacement in the direction of the longitudinal extension of the machine frame by displacement drive 49. This makes it possible to maintain the times of the stabilizing cycles substantially constant if the times of the tamping cycles vary.

Central control 6 automatically imparts to track 11 horizontal vibrations extending in a direction perpendicular to the track by operating vibrators 38 and applies to the vibrating track a maximum vertical load by operating drives 36. It automatically controls the maximum vertical load and reduces the maximum value of the vertical load, operates tamping assembly 16 by operating vertical adjusting drives 18 and reciprocating drives 19. Drives 18 and 36 may be operated simultaneously or, as will be described hereinafter in connection with FIG. 9, the tamping and stabilizing cycles may be staggered in time, i.e. they may be of different durations.

Figure 3:
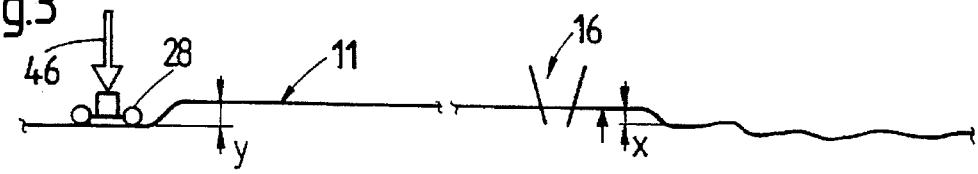
FIGS. 3 to 6 are highly simplified, diagrammatic illustrations of the tamping and stabilizing cycles of the method of the present invention.
Figure 4:
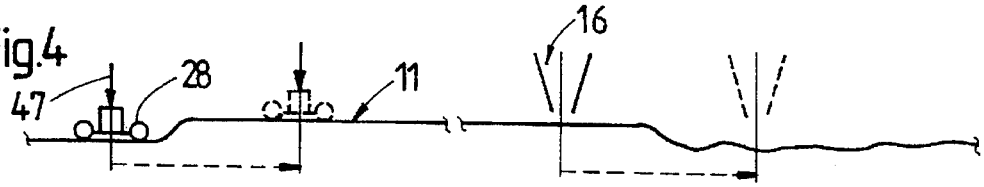

The method of operation of the above-described machine including track tamping assembly 16 and track stabilization assembly 28 will now be described more fully in connection with FIGS. 3 to 6. As shown in FIG. 3, track 11 is lifted by value x to a temporary level, indicated by small arrows delimiting the lifting stroke, is lined, if required, and is tamped in the corrected position. The tamping requires the machine advance to be halted. Parallel to, and following the tamping in the operating direction, track stabilization assembly 28 is operated to stabilize the tamped track at the desired level by the controlled lowering of the tamped track by value y, which is a set value in control 6. This requires the application of a maximum load to drives 36, indicated by arrow 46 in FIG. 2. A track level sensor 48 on measuring carriage 30 cooperates with tensioned wire 39 of reference system 29 to record the desired track level and automatically reduces the maximum vertical load to a minimum vertical load, indicated by arrow 47 in FIG. 2, upon contact of sensor 48 with wire 39 (FIG. 4). Under most conditions, the maximum load value is reduced by at least 20 percent, preferably 50 percent, and up to 100 percent to a level sufficient to guide track stabilization assembly 28 securely along the track and keep it in frictional engagement therewith. The ideal extent of the load reduction depends on various parameters, such as the maximum vertical load required to attain the desired track level, the duration of the stabilizing steps, the frequency of the vibrations, etc.

As shown in FIG. 4, as soon as the tamping operation has been completed, drives 18 as operated to raise track tamping assembly 16, and track tamping and stabilization assemblies 16, 28 are advanced along the track in the operating direction so that the track is tamped intermittently in continuously repeated tamping cycles. During this advance, the reduced load is applied to drives 36 while roller disks 44 remain frictionally engaged with rails 9 so that the track stabilization assembly stays in its operating position. In this way, the tamped track is intermittently stabilized at the desired level in continuously repeated stabilizing cycles parallel to, and following the tamping cycles in the operating direction. While the load is reduced, the frequency of the horizontal vibrations may be maintained unchanged or may be reduced, if desired, at the same time as the vertical load value is reduced. It is also possible to reduce the maximum vertical load value before the track has been stabilized at the desired level, and the track is stabilized at the desired level by applying thereto the reduced vertical load value. The reduced value of the vertical load may be raised to the maximum vertical load value at the same time tamping of the track is started, and as shown in FIGS. 3 to 6, the tamping and stabilizing cycles may be kept at a constant distance.

Figure 5:
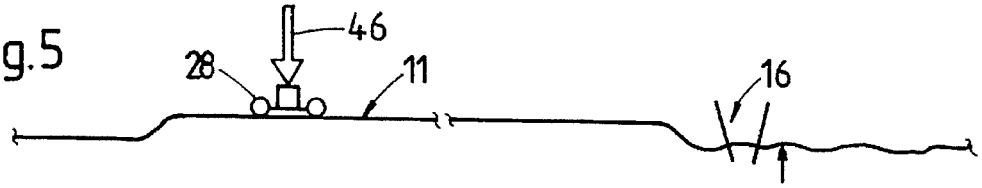
Figure 6:
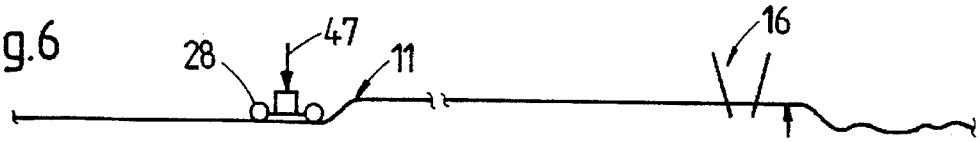

As shown in broken lines in FIG. 4, after the subsequent tamping station has been reached, the advance is interrupted, track tamping assembly 16 is lowered by drives 18 to immerse tamping tools 17 in the cribs between the ties, reciprocating drive 19 are operated to tamp ballast under ties 10, and the maximum load is applied to drives 36 while vibrators 38 are operated to settle track 11 at the desired level (FIG. 5). After the track has settled at the desired level by operation of track stabilization assembly 28 and tamping has been completed by operation of tamping assembly 16, a new operating cycle starts by lifting the tamping assembly, reducing the vertical load value to relieve the maximum load, and advancing machine 1 to repeat the intermittent tamping and stabilizing cycles.

Figure 7:
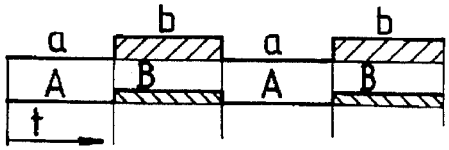
FIGS. 7 to 9 are like diagrams of the steps in the tamping and stabilizing cycles.
Figure 8:
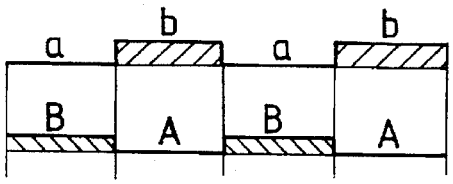
Figure 9:
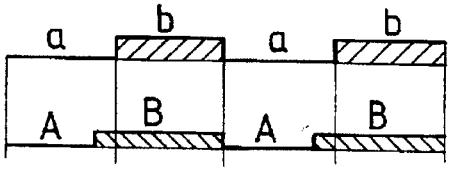

FIGS. 7 to 9 diagrammatically illustrate the operating steps of the tamping and stabilizing cycles. In the diagrams, "a" indicates the tamping step, "b" the advance, and "A" and "B" the stabilization at the maximum and reduced load values, respectively. "t" indicates the time coordinate, i.e. the duration of the indicated steps.

FIG. 7 shows an operation in which tamping step "a" and track stabilization at maximum load value "A" are initiated at the same time in each cycle. Parallel to advance "b", the vertical load value in part "B" of the stabilizing cycle is reduced. In this way, the cycles and their parts proceed synchronously.

In the operation shown in FIG. 8, the tamping and stabilizing cycles are staggered by one part of the cycles. In other words, during the tamping part "a" of the tamping cycle, the vertical load value is reduced in part "B" of the stabilizing cycle. Track stabilizing part "A" of the stabilizing cycle proceeds parallel to advance part "b" of the tamping cycle. In the operations illustrated in FIGS. 7 and 8, the duration of the stabilizing cycle may be conformed to the duration of the tamping cycle if the magnitude of the maximum vertical load is reduced, for example, so as to extend the duration of the stabilizing cycle.

In the operation illustrated in FIG. 9, stabilizing cycle part "A", which is initiated by raising the vertical lead value to the maximum, lasts a shorter time than tamping cycle part "a" started at the same time. This means that stabilizing part "B", during which the load value is reduced, starts while tamping still goes on, and continues until the next tamping cycle begins. In this case, a slow advance of chassis 25 of the track stabilization car can begin after part "A" of the stabilizing cycle has been completed by actuating longitudinal displacement drive 49 to displace universal coupling 27 relative to machine frame 3.

In all three examples of tamping and stabilizing a track at a desired level according to the invention, as illustrated in FIGS. 7 to 9, the stabilizing cycle comprises a part in which a maximum vertical load is applied to the track and a subsequent part in which this load is reduced.

What is claimed is:

1. A method of tamping and stabilizing a track at a desired level, which comprises the steps of (a) lifting the track to a temporary level, (b) intermittently tamping the track and then advancing along the track in an operating direction in continuously repeated tamping cycles, and (c) in continuously repeated stabilizing cycles parallel to and following the tamping cycles in the operating direction, intermittently stabilizing the tamped track at the desired level by (1) imparting to the track horizontal vibrations extending in a direction perpendicular to the track, and (2) applying to the vibrating track a vertical load at a value automatically controlled to rise to a maximum value required to lower the track to the desired level and then reduced to a value to relieve the load, the reduced value of the vertical load being raised to the maximum vertical load value at the same time tamping of the track is started.

2. The method of claim 1, wherein the maximum value of the vertical load is reduced by 20 to 100 percent.

3. The method of claim 2, wherein the maximum value of the vertical load is reduced by at least 50 percent while proceeding along the track.

4. The method of claim 1, wherein the tamping and stabilizing cycles are kept at a constant distance.

5. The method of claim 1, wherein the frequency of the horizontal vibrations is reduced at the same time as the vertical load value is reduced.

6. The method of claim 1, wherein the maximum vertical load value is reduced before the track has been stabilized at the desired level and the track is stabilized at the desired level by applying thereto the reduced vertical load value.

7. A machine for tamping and stabilizing a track consisting of rails fastened to ties, which comprises (a) a machine frame supported on the track by undercarriages and adapted to be advanced intermittently from tie to tie in an operating direction, (b) a vertically adjustable tamping assembly mounted on the machine frame, (c) a vertically adjustable track lifting and lining unit mounted on the machine frame, (d) a reference system mounted on the machine frame and including a measuring carriage running on the track for controlling lifting of the track by the lifting and lining unit to a temporary level, (e) a track stabilization car arranged rearwardly of the machine frame in the operating direction and supported on the track by an undercarriage, the track stabilization car having a forward end in the operating direction, the forward car end being supported on the machine frame, (f) a track stabilization assembly mounted on the track stabilization car, the track stabilization assembly comprising (1) means for imparting to the track horizontal vibrations extending in a direction perpendicular to the track, and (2) means for applying to the vibrating track a vertical load at a value automatically controlled to rise to a maximum value required to lower the track to the desired level and then reduced to a value to relieve the load, (g) a universal coupling connecting a forward end of the track stabilization car to the machine frame, and (h) a further and separate reference system on the track stabilization car determining the desired track level.

8. The track tamping and stabilizing machine of claim 7, wherein the track stabilization car comprises a chassis extending in a horizontal plane passing through the universal coupling, and the chassis defines an upper boundary of the car.

9. The track tamping and stabilizing machine of claim 8, further comprising an operator's cab mounted at an end of the machine frame in the region of the universal coupling and overlooking the upper boundary of the car.

10. The track tamping and stabilizing machine of claim 7, wherein the reference system comprises a further measuring carriage at a rear end of the reference system, in the operating direction, the further measuring carriage serving also as a front measuring carriage of the further reference system in the operating direction.

11. The track tamping and stabilizing machine of claim 7, further comprising drives for vertically adjusting the tamping and track stabilization assemblies, and a central control for the means for imparting to the track horizontal vibrations extending in a direction perpendicular to the track, the means for applying to the vibrating track a maximum vertical load, the means automatically controlling the maximum vertical load and reducing the maximum value of the vertical load, means for operating the tamping assembly, and the vertical adjusting drives.

12. A method of tamping and stabilizing a track at a desired level, which comprises the steps of (a) lifting the track to a temporary level, (b) intermittently tamping the track and then advancing along the track in an operating direction in continuously repeated tamping cycles, and (c) in continuously repeated stabilizing cycles parallel to and following the tamping cycles in the operating direction, intermittently stabilizing the tamped track at the desired level by (1) imparting to the track horizontal vibrations extending in a direction perpendicular to the track, and (2) applying to the vibrating track a vertical load at a value automatically controlled to rise to a maximum value required to lower the track to the desired level and then reduced to a value to relieve the load, the reduced value of the vertical load being applied at the same time tamping of the track is started.

13. The method of claim 12, wherein the maximum value of the vertical load is reduced by 20 to 100 percent.

14. The method of claim 13, wherein the maximum value of the vertical load is reduced by at least 50 percent while proceeding along the track.

15. The method of claim 12, wherein the tamping and stabilizing cycles are kept at a constant distance.

16. The method of claim 12, wherein the frequency of the horizontal vibrations is reduced at the same time as the vertical load value is reduced.

17. The method of claim 12, wherein the maximum vertical load value is reduced before the track has been stabilized at the desired level and the track is stabilized at the desired level by applying thereto the reduced vertical load value.

* * * * *